US011649960B2

(12) United States Patent
Kraus et al.

(10) Patent No.: US 11,649,960 B2
(45) Date of Patent: May 16, 2023

(54) LOW NOX BURNER WITH BYPASS CONDUIT

(71) Applicant: Honeywell International Inc., Charlotte, NC (US)

(72) Inventors: Kurt Kraus, Tulsa, OK (US); Dusty Ray Richmond, Cleveland, OK (US); Lev Davydov, Northbrook, IL (US); William J. Whyman, Tulsa, OK (US)

(73) Assignee: Honeywell International Inc., Charlotte, NC (US)

( * ) Notice: Subject to any disclaimer, the term of this patent is extended or adjusted under 35 U.S.C. 154(b) by 0 days.

(21) Appl. No.: 17/451,933

(22) Filed: Oct. 22, 2021

(65) Prior Publication Data

US 2022/0316700 A1 Oct. 6, 2022

Related U.S. Application Data

(60) Provisional application No. 63/170,139, filed on Apr. 2, 2021.

(51) Int. Cl.

| | |
|---|---|
| ***F23C 6/04*** | (2006.01) |
| ***F23D 14/08*** | (2006.01) |
| ***F23C 7/00*** | (2006.01) |
| ***F23C 9/00*** | (2006.01) |

(52) U.S. Cl.

CPC ..... *F23C 6/045* (2013.01); *F23C 7/008* (2013.01); *F23C 9/00* (2013.01); *F23D 14/08* (2013.01); *F23C 2900/06041* (2013.01)

(58) Field of Classification Search

CPC .. F23C 6/045; F23C 7/008; F23C 9/00; F23D 14/08

USPC ..... 431/115–116, 9

See application file for complete search history.

(56) References Cited

U.S. PATENT DOCUMENTS

| | | | | |
|---|---|---|---|---|
| 4,347,052 | A * | 8/1982 | Reed | F23C 6/047 431/284 |
| 4,505,666 | A | 3/1985 | Martin et al. | |
| 4,862,835 | A * | 9/1989 | Oppenberg | F23C 9/06 122/18.31 |
| 5,073,105 | A | 12/1991 | Martin et al. | |
| 6,875,008 | B1 | 4/2005 | Martin et al. | |
| 6,893,251 | B2 | 5/2005 | Stephens | |
| 7,950,919 | B2 | 5/2011 | Johnson et al. | |
| 10,690,339 | B2 | 6/2020 | Martin et al. | |

(Continued)

FOREIGN PATENT DOCUMENTS

CN 210740397 U 6/2020

OTHER PUBLICATIONS

International Search Report from corresponding PCT application No. PCT/US2022/071508, dated Jul. 27, 2022.

(Continued)

*Primary Examiner* — Vivek K Shirsat

(57) ABSTRACT

A burner and methods of using the burner. The burner utilizes bypass conduits to separate the combustion air that is passed to the primary combustion zone into two or more portions. The two portions are injected into the primary combustion zone at different points so as to reduce the flame temperature. A NOx reducing medium may be mixed with the combustion air in the bypass conduit. The NOx reducing medium may be flue gases from a combustion chamber having the primary combustion zone.

17 Claims, 10 Drawing Sheets

(56) References Cited

U.S. PATENT DOCUMENTS

| | | | |
|---|---|---|---|
| 2003/0175637 | A1 | 9/2003 | Stephens |
| 2003/0190570 | A1 | 10/2003 | Jones et al. |
| 2005/0175945 | A1 | 8/2005 | Chung et al. |
| 2008/0206693 | A1 | 8/2008 | Lifshits et al. |
| 2020/0191385 | A1 | 6/2020 | Carroll et al. |
| 2020/0325087 | A1 | 10/2020 | Mostofi-Ashtiani et al. |
| 2020/0386404 | A1 | 12/2020 | Kraus et al. |
| 2021/0009904 | A1 | 1/2021 | Frey et al. |

OTHER PUBLICATIONS

Written Opinion from corresponding PCT application No. PCT/US2022/071508, dated Jul. 27, 2022.

De Ren, Jan et al., A Paradigm Shift in Steam Assisted Elevated Flare Systems, Journal of the International Flame Research Foundation, Article No. 201619, Jul. 2020, ISSN: 2075-3071.

Nitrogen Oxides (NOx), Why and How They are Controlled, EPA Technical Bulletin, Nov. 1999 (available at: https://nepis.epa.gov/Exe/ZyPDF.cgi/2000F9IK.PDF?Dockey=2000F9IK.PDF).

API Recommended Practice 535, Burners for Fired Heaters in General Refinery Services, Third Edition, May 2014 (abstract and TOC only).

Wolschlag, Lisa M. et al., UOP FCC Design Advancements to Reduce Energy Consumption and CO2 Emissions, 2009, UOP LLC.

* cited by examiner

LOW NOX BURNER WITH BYPASS CONDUIT

RELATED APPLICATIONS

This application claims priority to U.S. Provisional Patent Application Ser. No. 63/170,139 filed on Apr. 2, 2021, the entirety of which is incorporated herein by reference.

FIELD OF THE INVENTION

This invention relates generally to a gas burner and more particularly to a gas burner having a lower NOx production.

BACKGROUND OF THE INVENTION

Petroleum refining and petrochemical processes frequently involve heating process streams in a furnace. The interior chamber of the furnace contains tubes which contain the process streams. The interior chamber is heated by a plurality of gas burners which receive a fuel which combusts to produce heat.

One area of concern for gas burners is the production of NOx gases. As would be appreciated, NOx refers to oxides of nitrogen, principally comprised of nitric oxide, NO, and nitric dioxide, $NO_2$. It is believed that there are at least three principal NOx formation mechanisms in combustion processes: Thermal NOx, Fuel NOx, and Prompt NOx. See, "Nitrogen Oxides (NOx), What and How They are Controlled," EPA Technical Bulletin November 1999 (available at: https://www3.epa.gov/ttncatc1/dir1/fnoxdoc.pdf).

It is known that NOx formation in gas burners can be mitigated by staging fuel and air and creating primary and secondary combustion (flame) zones. Staged air and staged fuel burners work primarily on the Thermal NOx and Prompt NOx formation processes. The highest flame temperatures, and thereby the greatest potential for Thermal NOx formation, is achieved when gaseous fuels and combustion air are thoroughly mixed and rapidly combusted in or near stoichiometric proportions.

Accordingly, the staged air and staged fuel burners seek to lower the temperature of the flame and thereby lower the NOx production. Classic staged fuel or staged air burners produce two combustions zones for off-stoichiometric combustion.

In the case of the staged fuel burner, all the combustion air passes through the primary combustion zone and into the secondary combustion zone with the partial combustion products of the primary combustion zone. In this case, the primary combustion zone is lean, having an excess amount of combustion air. Lean combustion reduces the flame temperature, in part, as all of the mass of the combustion air rapidly absorbs and commutes heat from the flame out of the primary combustion zone and thus allowing time (measurable in milliseconds) for heat to radiate out of the primary combustion zone to the surrounding environs including to the heater, boiler or furnace process tubes. The fully and/or partially combusted (reacted) products of combustion pass from the primary combustion zone to the secondary or staged combustion zone. This transit allows time (again measurable in milliseconds) for the primary combustion zone products to further radiate heat out to the surrounding environs and process tubes. Therefore, the somewhat cooled combustion products from the primary combustion zone act to conduct heat from and cool the secondary combustion zone. Further, the secondary combustion zone combustion reactions occur, on average, at relatively lean conditions as the typical process heater, boiler or furnace operates at lean conditions with an excess of 5% to 25% combustion air. Thereby the combustion process is complete to a fair degree, industrially acceptable level of efficiency, 5% to 25% excess air.

The classic staged air burner reverses the staging process and introduces all the fuel gas for combustion in the primary combustion zone and only a portion of the combustion air. In the case of the staged air burner, the primary combustion zone may operate sub-stoichiometrically and achieve industrially acceptable excess air levels, 5% to 25% excess air, as reactants and products pass through the secondary combustion zone. With the staged air burner, the reactants must pass through a region of near stoichiometry where flame temperatures, and thereby Thermal NOx formation, is high and therefore staged air burners can have difficulty delivering very low NOx emissions.

More recently, internal flue gas recirculation burners have utilized flue gas within the heater or furnace combustion chamber which is motivated by the fuel gas and mixed into the primary and secondary combustion zones. This flue gas, relatively cool, massive products of combustion (flue gas), pass into and through the combustion zones thereby further cooling the combustion zone and reducing Thermal NOx formation. The water vapor in the flue gas also serves to mitigate NOx created via the Prompt NOx mechanism by solvating and catalyzing hydrocarbon combustion by more recently understood Water Gas Shift Reaction ("WGSR") mechanisms described in "A Paradigm Shift in Steam Assisted Elevated Flare Systems," International Flame Research Foundation, July 2020, by Jan De Ren, Kurt Kraus and Chris Ferguson. These WGSR mechanisms are also present to a limited degree in classic or conventional staged fuel or staged air burners as products of combustion from the primary combustion zone to the secondary combustion zone includes some water vapor.

Both staged air and staged fuel burners can require and produce large, voluminous flames to achieve low NOx emissions. Modern heater and furnace designs must be designed for larger, more costly combustion chambers to allow for larger low NOx emission burner flames of staged fuel and staged air burners.

Therefore, there remains a need for a burner that has a low NOx production that does not suffer from these drawbacks.

SUMMARY OF THE INVENTION

A new burner and methods of using same have been invented. According to the present invention, the new burner utilizes one or more bypass conduits to separate the combustion air that is passed to the primary combustion zone into two or more portions. Off-stoichiometric combustion, either rich or lean, is known to reduce flame temperature and alters the formation of intermediate products of combustion, thereby reducing formation when formed by various known or theorized mechanisms including Thermal NOx and Prompt NOx formation. These portions are injected into the primary combustion zone at different points so as to facilitate the designed control of the stoichiometry at various locations within the flame. Accordingly, the flame temperature and nature of intermediate products of combustion can now be designed for various locations within the flame, thereby lowering NOx production.

While the use of the bypass conduit reduces the NOx production, it has been further found that the NOx gas produced by the flame can be further reduced by mixing a NOx reducing medium or media with the combustion air in the bypass conduit. The NOx reducing medium may be mixed with fuel gas, with the combustion air, injected into, alongside or outside the bypass conduit, or any combination of the foregoing. The present invention contemplates various sources for the NOx reducing medium, but one specifically contemplated source is flue gas produced by the flame at the burner. Other NOx reducing media include steam, nitrogen, carbon dioxide and various process off-gas, waste gas or synthesized streams that may contain various amounts of these listed or other gaseous components. One process off-gas is Pressure Swing Absorber, PSA, off-gas which typically can contain varying amounts of nitrogen, carbon dioxide, water vapor, methane, and other light hydrocarbons. Those NOx reducing media that contain water vapor, such as steam and flue gas, also drive Water Gas Shift Reaction processes. Minimizing, the amount of NOx reducing medium needed to achieve a desired level of NOx emissions reduces the operating cost of delivering the medium. Meanwhile, excessive amounts of NOx reducing medium can interrupt the combustion process, making the burner unstable or even extinguishing the burner flame. Various control schemes described herein modulate or control the amount of NOx reducing medium delivered to the various locations in the burner to mitigate NOx formation to the desired levels while maintaining safe, stable, continuous combustion and heat delivery.

The NOx reducing medium can thus be injected at various locations within a single burner. Further, the NOx reducing medium may be injected at any one location in any single burner.

Accordingly, the present invention may be characterized, in at least one aspect, as providing a process for the directed and prescribed mixing of fuel, air, and NOx reducing medium at multiple locations within the burner and flame zone. The directed injection of the various components and the resulting controlled mixing and reaction rates minimizes the amount of needed NOx reducing medium to achieve maximum NOx reducing effect within the combustion process. Not only are certain locations decidedly designed to operation rich or sub-stoichiometric, in that location that is in a sub-stoichiometric state, NOx reducing medium can be specifically directed and mixed. Similarly, in locations that are lean, super-stoichiometric, differing rates, and compositions of NOx reducing media are directed to affect NOx reduction. For example, it is known that the bluff body or stabilization cavity locations of a burner can be areas high NOx formation. These locations are therefore targets for off-stoichiometric operation and directed flue gas reducing media.

Thus, the present invention may be broadly characterized as providing a burner having: a plenum; a burner tile arranged such that a first portion of a combustion air from the plenum flows from the plenum through the burner tile to a primary combustion zone; at least one conduit having an outlet configured to inject a fuel stream comprising a fuel gas into the primary combustion zone; and, a bypass conduit having an outlet configured to inject a second portion of the combustion air from the plenum into the primary combustion zone. The second portion of the combustion air is injected downstream relative to the first portion of the combustion air. The burner may include a plurality of bypass conduits each having an outlet configured to inject some of the second portion of the combustion air from the plenum into the primary combustion zone. The bypass conduits from the plurality of bypass conduits may be concentric. The bypass conduits from the plurality of bypass conduits may each have a different length relative to a distance from the burner tile to the outlets of each of the bypass conduits. The bypass conduits from the plurality of bypass conduits may be arranged in a parallel arrangement. The burner may also include a pre-mixer configured to mix the fuel gas and some of the combustion air upstream of the combustion zone such that the fuel stream further comprises the combustion air. The bypass conduit has an inlet, and the inlet may have either an increasing inner measurement to increase a proportion of the combustion air entering the bypass conduit from the plenum or a decreasing inner measurement to decrease a proportion of the combustion air entering the bypass conduit from the plenum. The burner may further include at least one conduit configured to pass an NOx reducing medium to the combustion zone.

In another aspect, the present invention may generally be characterized as providing a burner having: a plenum; a burner tile arranged such that a first portion of a combustion air from the plenum flows from the plenum through a passage in the burner tile to a primary combustion zone; at least one conduit having an outlet configured to inject a fuel stream comprising a fuel gas into the primary combustion zone; a bypass conduit having an outlet configured to inject a second portion of the combustion air from the plenum into the primary combustion zone; and, at least one conduit configured to pass an NOx reducing medium into the bypass conduit, the passage in the burner tile, or both. The second portion of the combustion air is injected downstream relative to the first portion of the combustion air. The NOx reducing medium may be recycled flue gas produced in the primary combustion zone. The burner may include a fan configured to draw flue gas from the primary combustion zone to a recycle conduit. Additionally, the burner may include a heat exchanger configured to recover heat from and cool the recycled flue gas before the recycled flue gas is passed back to the primary combustion zone. The burner may include a pre-mixer configured to mix the fuel gas and some of the combustion air upstream of the combustion zone such that the fuel stream further comprises the combustion air. The NOx reducing medium may be injected into the pre-mixer. The NOx reducing medium may be mixed with the fuel gas prior to the fuel gas being injected into the pre-mixer. The NOx reducing medium may be mixed with the combustion air in the plenum.

In some aspects, the present invention may generally be characterizing as providing a process for reducing production of NOx gases at a burner by: injecting a fuel gas into a primary combustion zone associated with a burner tile; injecting a first portion of a combustion air into the primary combustion zone, wherein the first portion of the combustion air and the fuel gas react and produce a flame in the primary combustion zone; and, injecting a second portion of the combustion air into the primary combustion zone, wherein the second portion of the combustion air is injected into the primary combustion zone downstream relative to the first portion of the combustion air. The second portion of the combustion air may be injected via a bypass conduit. The second portion of the combustion air may be injected via a plurality of bypass conduits each having an outlet configured to inject the second portion of the combustion air into the primary combustion zone. The bypass conduits from the plurality of bypass conduits may be concentric. The bypass conduits from the plurality of bypass conduits may each have a different length relative to a distance to from the burner tile to the outlets of each of the bypass conduits. The process may include passing an NOx reducing medium to the primary combustion zone. The NOx reducing medium may be a recycled flue gas from the primary combustion zone. The NOx reducing medium may be a flue gas from an FCC unit.

In still a further aspect, the present invention broadly may be characterized as providing a process for reducing production of NOx gases at a burner by: injecting a fuel gas into a primary combustion zone associated with a burner tile; injecting a first portion of a combustion air into the primary combustion zone, wherein the first portion of the combustion air and the fuel gas react and produce a flame in the primary combustion zone; injecting, via a bypass conduit, a second portion of the combustion air into the primary combustion zone, wherein the second portion of the combustion air is injected into the primary combustion zone downstream relative to the first portion of the combustion air; and, injecting an NOx reducing medium into the bypass conduit. The process may include monitoring at least one NOx value for the flame and adjusting a flowrate of the NOx reducing medium based on the at least one NOx value. The NOx reducing medium may be a recycled flue gas from the primary combustion zone. The NOx reducing medium may be a flue gas from an FCC unit.

Further, in some aspects, the present invention generally provides a process for reducing production of NOx gases at a burner by: injecting a fuel gas into a primary combustion zone associated with a burner tile; injecting a first portion of a combustion air into the primary combustion zone, wherein the first portion of the combustion air and the fuel gas react and produce a flame and a flue gas in the primary combustion zone; injecting a second portion of the combustion air into the primary combustion zone, wherein the second portion of the combustion air is injected into the primary combustion zone downstream relative to the first portion of the combustion air; and, recovering a portion of the flue gas produced in the primary combustion zone and recycling the portion of the flue gas back to the primary combustion zone. The process may include recovering heat from and cooling the portion of the flue gas recovered before the flue gas is recycled back to the primary combustion zone. The process may include comprising mixing the portion of the flue gas recovered with the combustion air. The process may include mixing the portion of the flue gas recovered with the first portion of the combustion air. The process may include mixing the portion of the flue gas recovered with the second portion of the combustion air. The process may include mixing the portion of the flue gas recovered with the fuel gas. The process may include injecting the portion of the flue gas recovered and the fuel gas into a pre-mixer.

According to some aspects the present invention may be generally characterized as providing a process for reducing production of NOx gases at a burner by: injecting a fuel gas into a primary combustion zone associated with a burner tile; injecting a combustion air into the primary combustion zone, wherein the combustion air and the fuel gas react and produce a flame and a flue gas in the combustion zone; and, injecting an NOx reducing medium into the primary combustion zone to reduce an NOx production at the flame, wherein the NOx reducing medium comprises a flue gas from an FCC unit. The burner tile may be associated with a burner in the FCC unit. The process may include mixing the NOx reducing medium with the combustion air prior to the combustion air being injected into the primary combustion zone. The process may include mixing the NOx reducing medium with the fuel gas prior to the fuel gas being injected into the primary combustion zone. The process may include mixing the NOx reducing medium with the fuel gas prior to the fuel gas being injected into the primary combustion zone.

Additional aspects, embodiments, and details of the invention, all of which may be combinable in any manner, are set forth in the following detailed description of the invention.

DETAILED DESCRIPTION OF THE DRAWINGS

One or more exemplary embodiments of the present invention will be described below in conjunction with the following drawing figures, in which.

DETAILED DESCRIPTION OF THE INVENTION

As mentioned above, the present invention provides, inter alia, a new burner. The new burner utilizes one or more bypass conduits to transfer a portion of the combustion air from the plenum into the primary combustion zone at a different location than another portion of the combustion air. This facilitates the primary combustion zone operating fully sub-stoichiometric, thereby significantly reducing the partial pressure of oxygen available for NOx formation in the primary combustion zone and delivering oxygen into the typically air starved, fuel rich staged combustion zone. Additionally, conduits may be used to inject NOx reducing media, or fluids, into, inter alia, the combustion air streams, the fuel gas, or even into the bypass conduit. While the bypass conduit alone is thought to reduce the NOx production of the flame, coupling the bypass conduit with the NOx reducing medium is believed to provide the greatest reduction in NOx production.

With these general principles in mind, one or more embodiments of the present invention will be described with the understanding that the following description is not intended to be limiting.

Figure 1A:
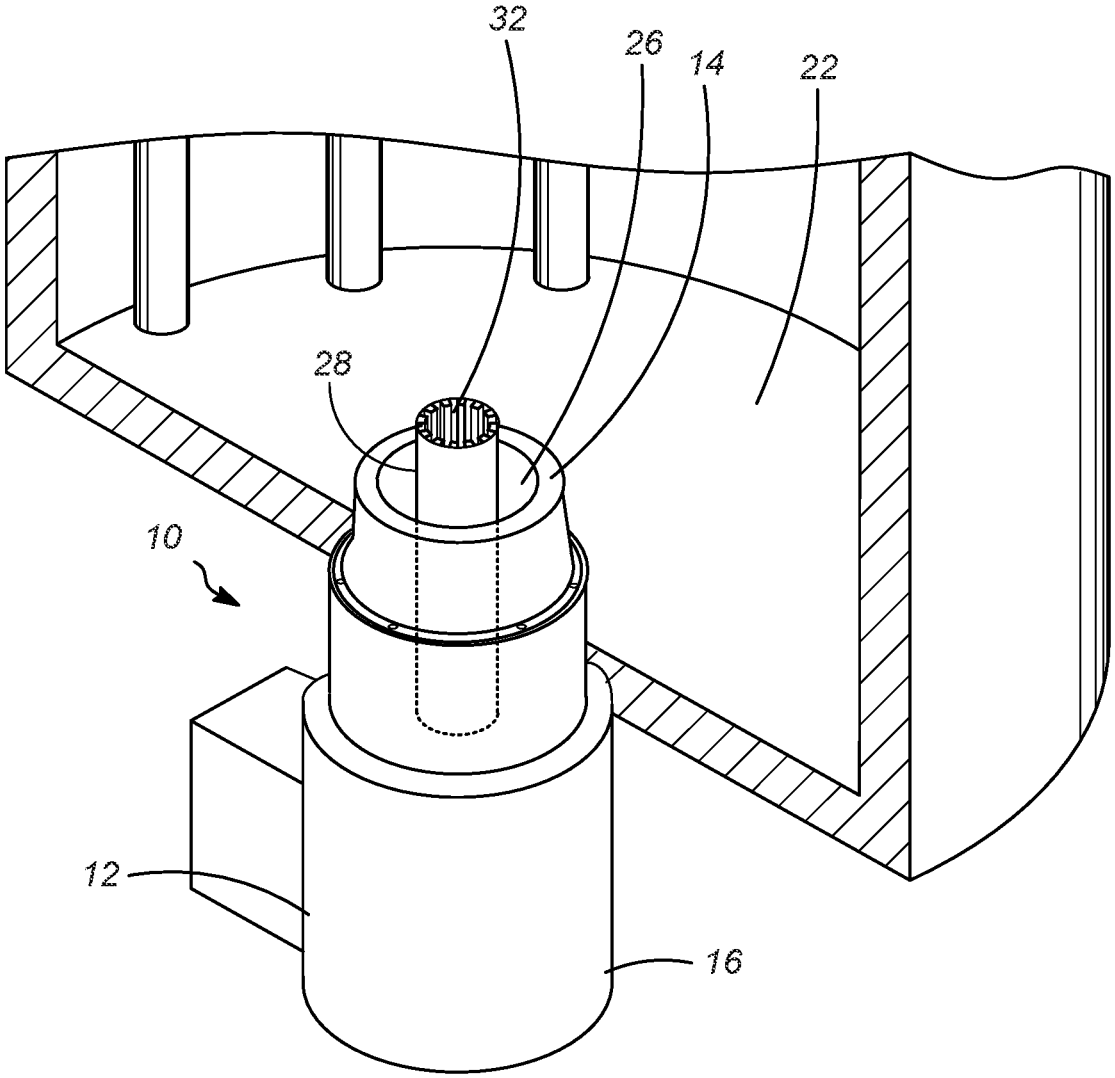
FIG. 1A is a perspective, partially cutaway view of a burner according to the present invention.

As shown in the FIGURES, and staring in FIG. 1A, a burner 10 according to various embodiments of the present invention includes a plenum, or wind box, 12 and a tile 14 disposed on top of the plenum 12. The use of the phrase "on top" is in relation to the drawings, as the burners 10 may be installed in different configurations/orientations.

Figure 1B:
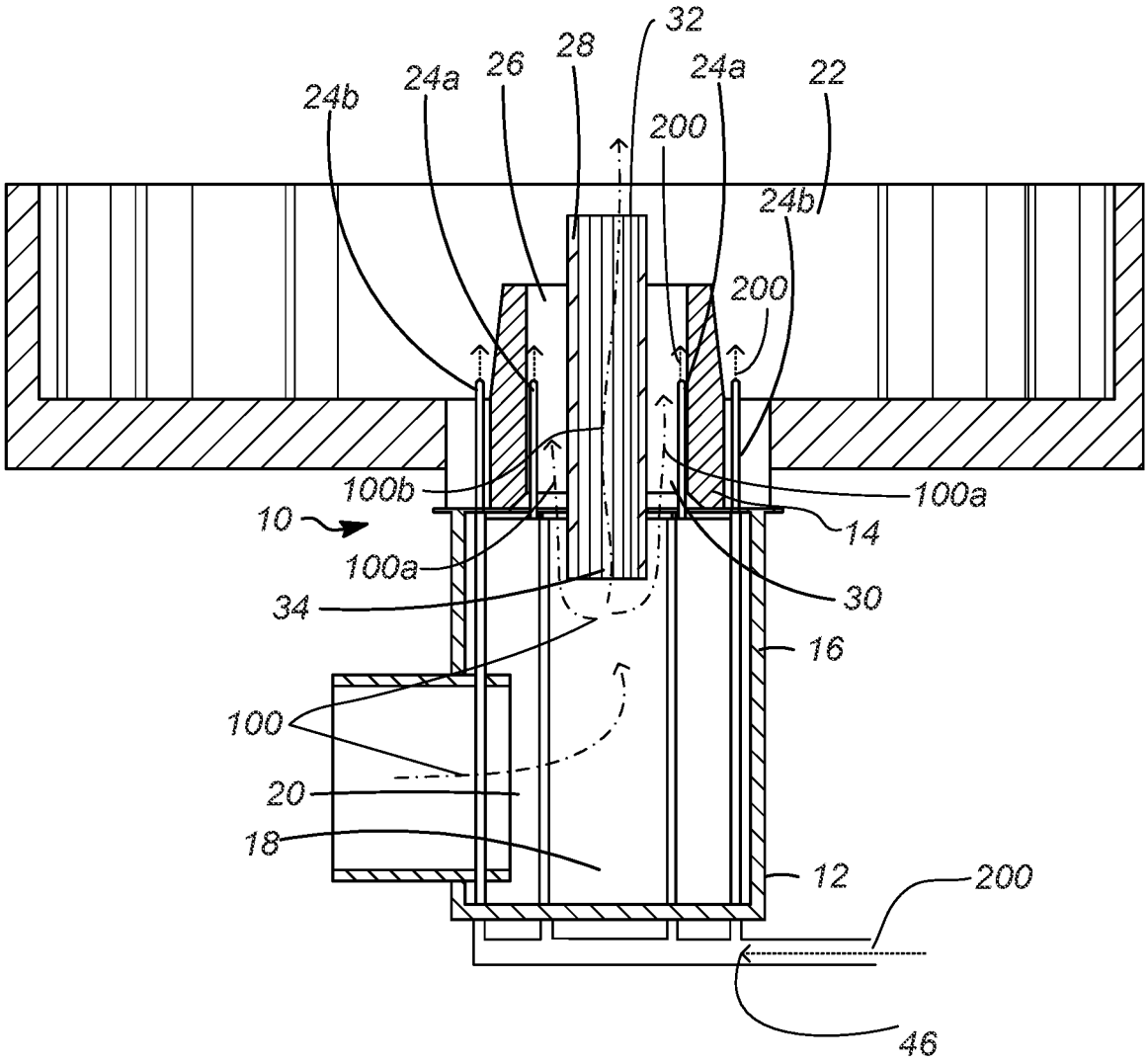
FIG. 1B is a side, cutaway view of the burner of shown in FIG. 1A.

With reference to FIG. 1B, the wind box 12 includes a body 16 that forms a cavity 18 having at least one opening 20 so that air, also called combustion air, naturally flows into the cavity 18. The flow of combustion air is indicated with arrows 100. Instead of a natural draft burner, a fan or blower can be present to force combustion air 100 into the wind box 12 to create a forced air burner. The combustion air 100 that enters the cavity 18 is passed through the tile 14 and is used is used to produce a flame above the tile 14 in a primary combustion zone 22 within a combustion chamber that may be a stack or furnace.

In addition to the combustion air, the primary combustion zone receives a fuel gas, indicated with arrows 200, for producing the flame. Accordingly, fuel lines, or conduits, 24*a*, 24*b* pass through the body 16 of the wind box 12 and through the burner tile 14. Some of the fuel lines 24*a* have outlets which inject a fuel stream with fuel gas 200 into the primary combustion zone. As will be described in more detail below, the fuel stream may include combustion air 100 and/or a non-combustion gas or NOx reducing medium. The depicted burner 10 also includes some fuel lines 24*b* which are configured to provide the fuel gas 200 to a secondary combustion zone outside of the primary combustion zone. Contemplated sources and/or compositions of the fuel gas include refinery fuel gas, synthetic fuel gas, process off gas, natural gas, propane, butane, LPG, hydrogen including up to 100% by volume, and any combination of the foregoing. The pressure of the fuel gas may vary from 0.07 to 2.07 Barg (1 to 30 psig).

As discussed above and will be appreciated by those of ordinary skill in the art, the fuel gas 200 in the fuel stream and the oxygen in the combustion gas 100 mix and may be used to produce a flame. The present burner 10 seeks to reduce the amount of NOx gases that are produced as a result of this combustion by separating the combustion air 100 that is passed to the primary combustion zone into different portions. This is in contrast to prior designs where the different portions of combustion air are injected into the primary and secondary combustion zones.

Accordingly, as shown best in FIG. 1B, the burner tile 14 has a throat 26 and a bypass conduit, or passage, 28 which allows some the combustion air 100 to pass from the plenum 12 to the primary combustion zone. More specifically, a conduit 30, or passage, having an annular profile is formed between the surface of the throat 26 and the outer surface of the bypass conduit 28.

A first portion 100*a* of the combustion air 100 from the plenum 12 flows through conduit 30 of the burner tile 14 to the primary combustion zone. A second portion 100*b* of the combustion air flows through the bypass conduit 28 and is injected via an outlet 32 into the primary combustion zone. Thus, relative to the first portion 100*a* of combustion air, the second portion 100*b* of combustion air is injected downstream into the primary combustion zone.

Figure 1C:
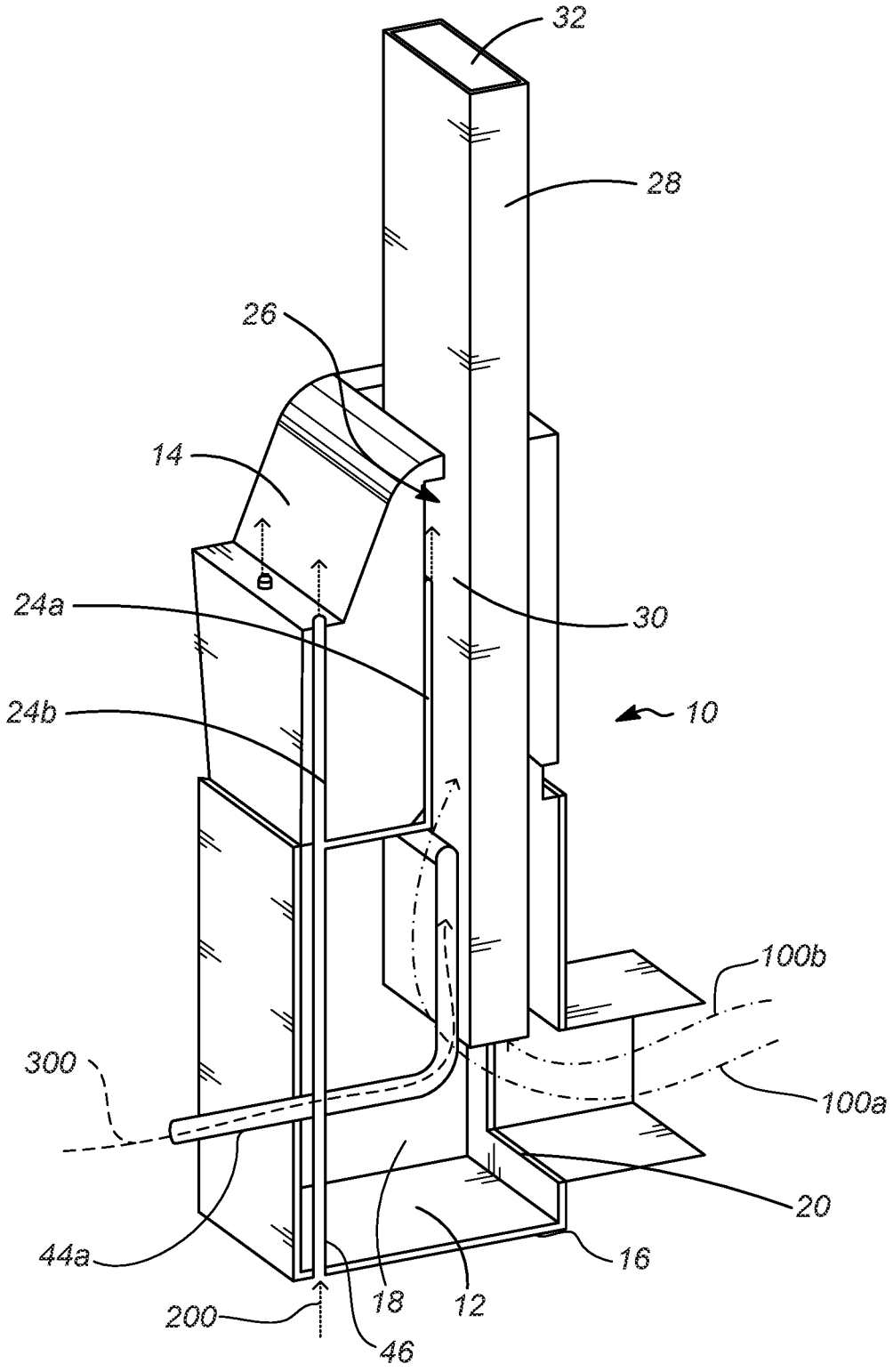
FIG. 1C is a perspective, cutaway view of a burner according to the present invention.

Turning to FIG. 1C, another embodiment of the burner 10 according to the present invention is shown in which the same reference numbers are used for the same features.

The burner 10 of FIG. 1C is used to produce a "flat" flame. Accordingly, the conduit or passage 30 for the first portion 100*a* of combustion air, formed between the surface of the throat 26 and the outer surface of the bypass conduit 28, has a rectangular profile instead of annular. Similarly, the bypass conduit 28, for the second portion of 100*b* of the combustion air, also has a rectangular profile.

In either configuration, by separating the combustion air 100 into multiple portions 100*a*, 100*b*, the amount of oxygen initially mixed with the fuel gas 200 in the primary combustion zone will be lower. The second portion 100*b* of combustion air 100 is still injected into the primary combustion zone, but the flame will have a lower temperature and thereby produce less NOx compared with a burner that mixes of all of combustion air in the primary combustion zone at the same time.

Additionally, unlike a burner which premixes a portion of the combustion air and fuel together upstream of the burner tile 14, the present invention mixes the combustion air in both portions 100*a*, 100*b* with the fuel gas downstream of the burner tile 14. Thus, the amount of fuel gas 200 in the first and second portions 100*a*, 100*b* of the combustion air is about the same, and should be minimal, if any.

Figure 2A:
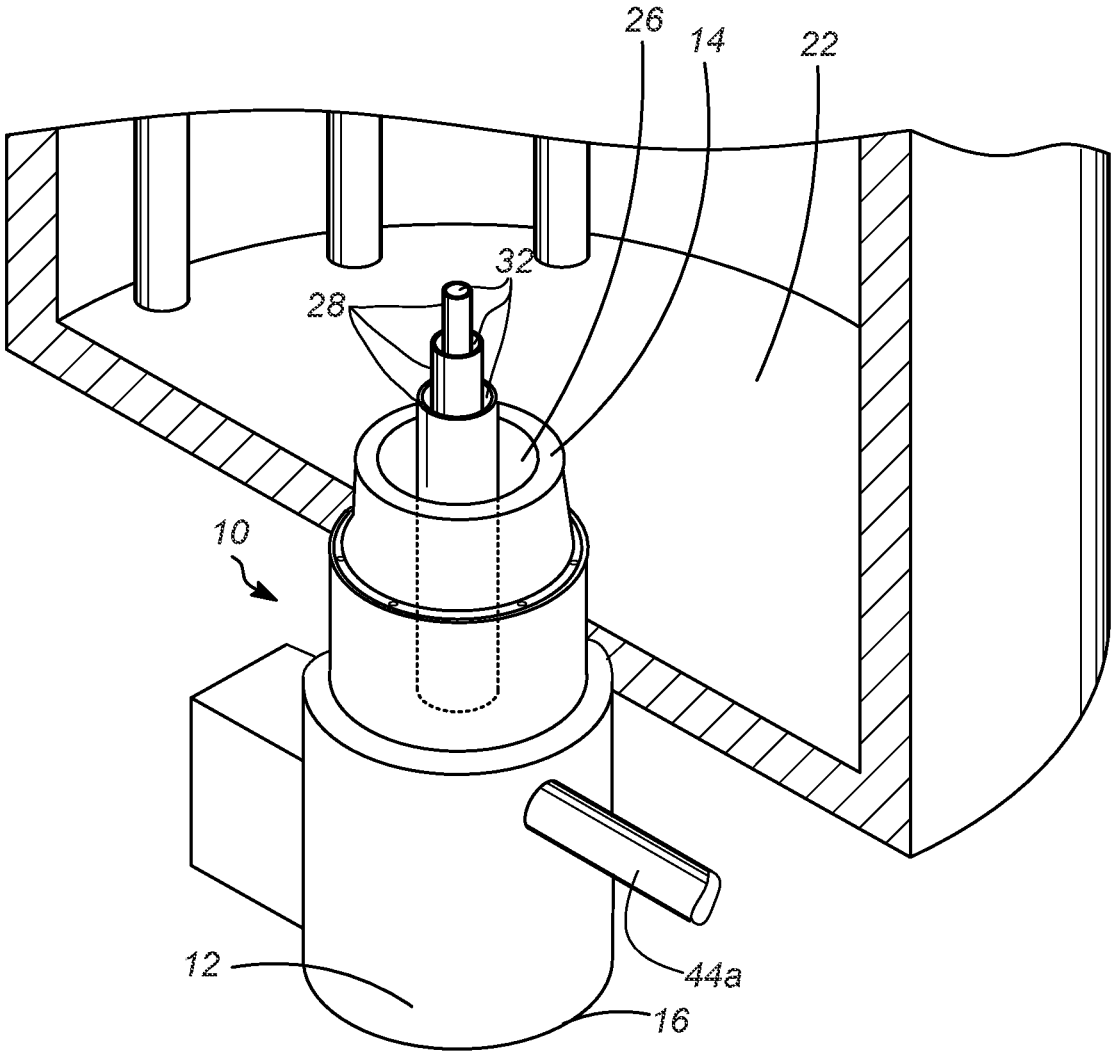
FIG. 2A is a perspective, partially cutaway view of a burner according to the present invention.
Figure 2B:
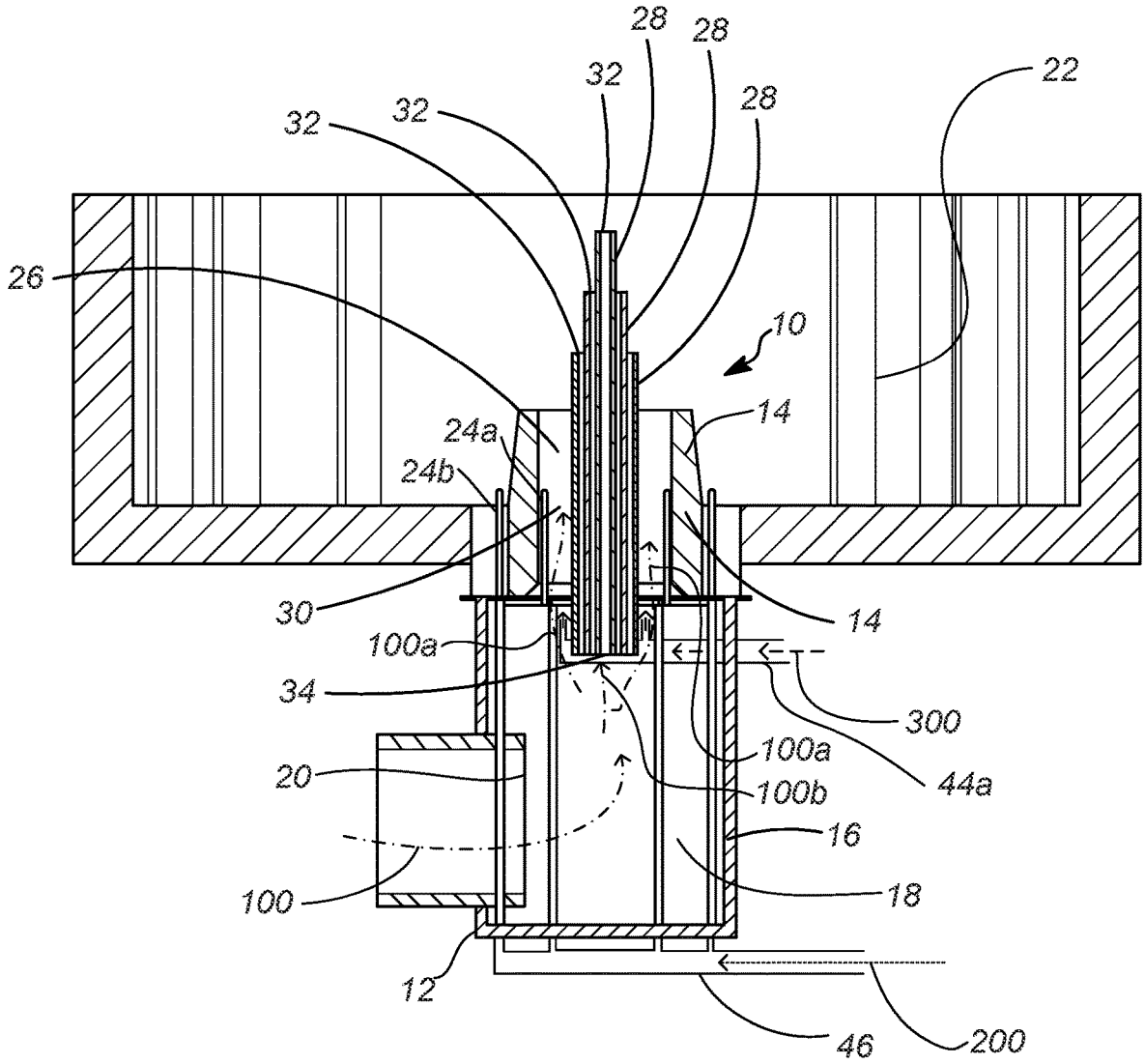
FIG. 2B is a side, cutaway view of the burner of shown in FIG. 2A.
Figure 3:
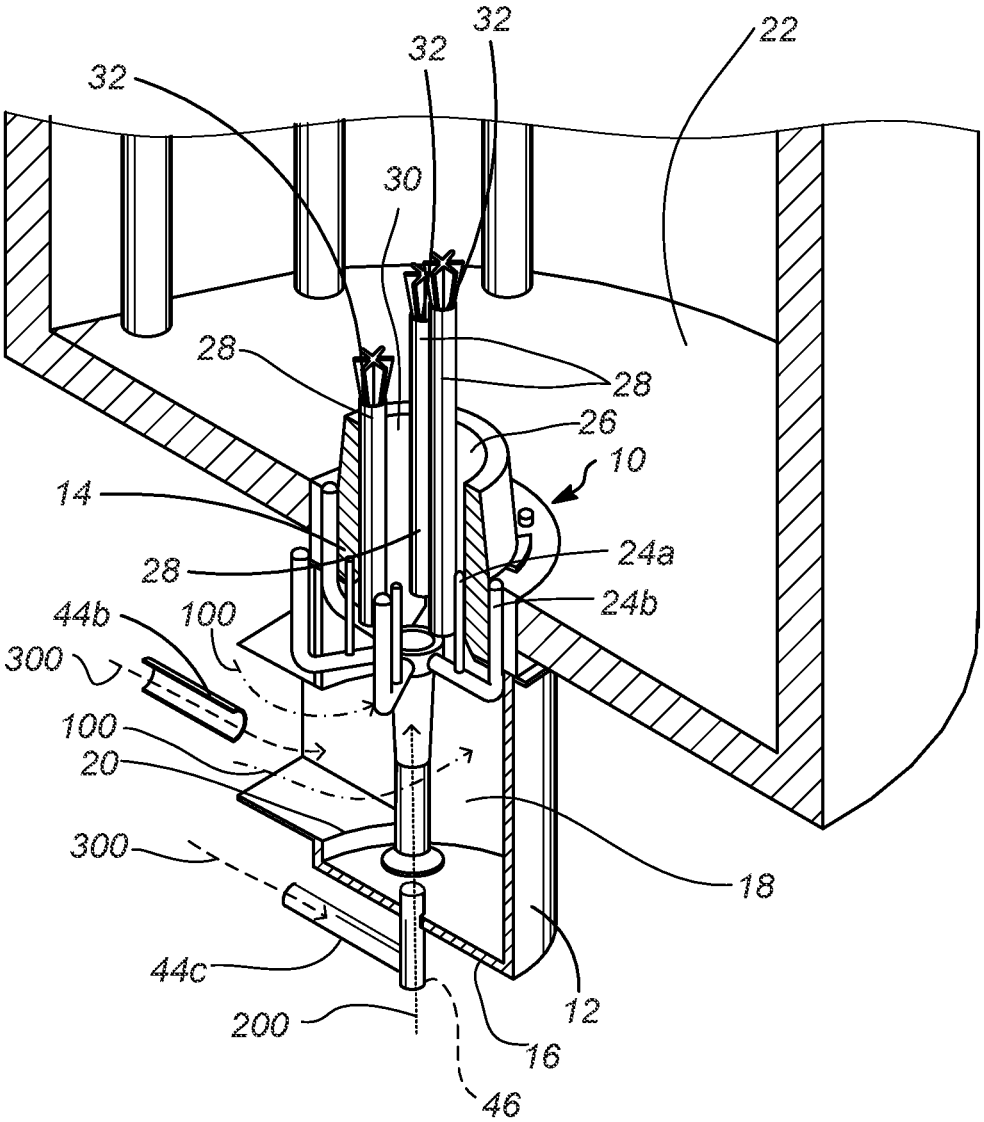
FIG. 3 is a perspective, partially cutaway view of a burner according to the present invention.

Turning to FIGS. 2A, 2B, and 3, it is contemplated that the burner 10 includes a plurality of bypass conduits 28.

For example, in FIGS. 2A and 2B, a plurality of concentric bypass conduits 28 are shown. Each of the bypass conduits 28 has an outlet 32 that is more downstream compared with an outlet 32 for a bypass conduits 28 that surrounds it.

Alternatively, as shown in FIG. 3 a plurality of nonconcentric bypass conduits 28 may be utilized. In the burner 10 of FIG. 3, the bypass conduits 28 have different lengths, meaning their respective outlets 32 are located at different distances from the tile 14 and the outlets 32 may be sequentially downstream from each other in the primary combustion zone. It is further contemplated, although not depicted as such, that the nonconcentric bypass conduits 28 instead have the same length. In either configuration, the nonconcentric bypass conduits 28 are generally parallel and the passage 30 for the second portion 100*b*, of combustion air is formed by the open space between the various bypass conduits 28.

Multiple bypass conduits 28 allow fine-grained control of the exact injection point(s) of the second portions 100*b* of the combustion air injected into the combustion zone. Multiple injection points extend the advantage that some of the combustion air bypasses the initial mixing in the primary combustion zone and allows nuanced application. For example, computational or physical modeling can find that certain physical locations are where significant NOx formation occurs when there is no bypass air. Bypassing these locations in the burners 10 with a portion of the combustion air 100 changes the stoichiometry at that specific location. Further modeling may demonstrate that the single bypass conduit 28, while reducing NOx formation, moves the location of where further significant, but reduced, NOx formation is occurring. Additional bypassing of combustion air around these new, but lesser, NOx formation locations or hot spots will further change the stoichiometry of these new locations and further reduce NOx formation.

Additionally, as should be appreciated, FIGS. 1A, 1B, 1C, 2A, and 2B depict a diffusion mix burner in which all of the fuel gas 200 is injected into the combustion zone 22 (i.e., furnace) and then is mixed with the combustion air. In FIG. 3, a partial premix burner is depicted, in which all of the fuel gas 200 is mixed with some combustion air 100 prior to being injected into the combustion zone 22. The remaining combustion air 100 that is not mixed with fuel gas 200 is injected into the combustion zone 22 and mixes with the fuel gas 200 therein.

In general, the bypass conduits 28 also each include an inlet 34 opposite the outlet 32. The inlet 34 of the bypass conduits 28 may take many configurations to increase, decrease, modulate, and/or otherwise prescribe or actively control the combustion air entering the bypass conduit.

Figure 4:
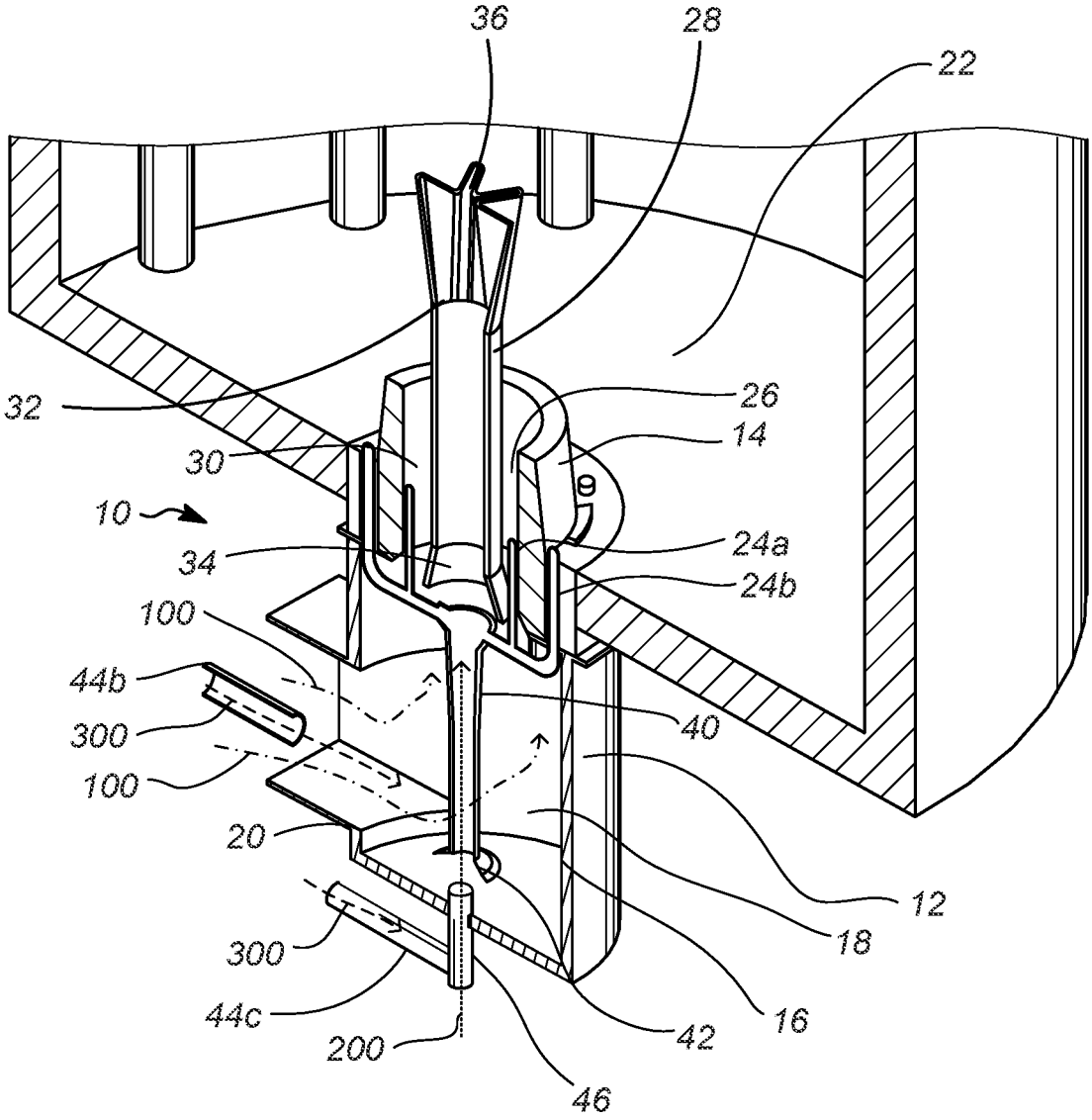
FIG. 4 is a perspective, partially cutaway view of a burner according to the present invention.
Figure 5:
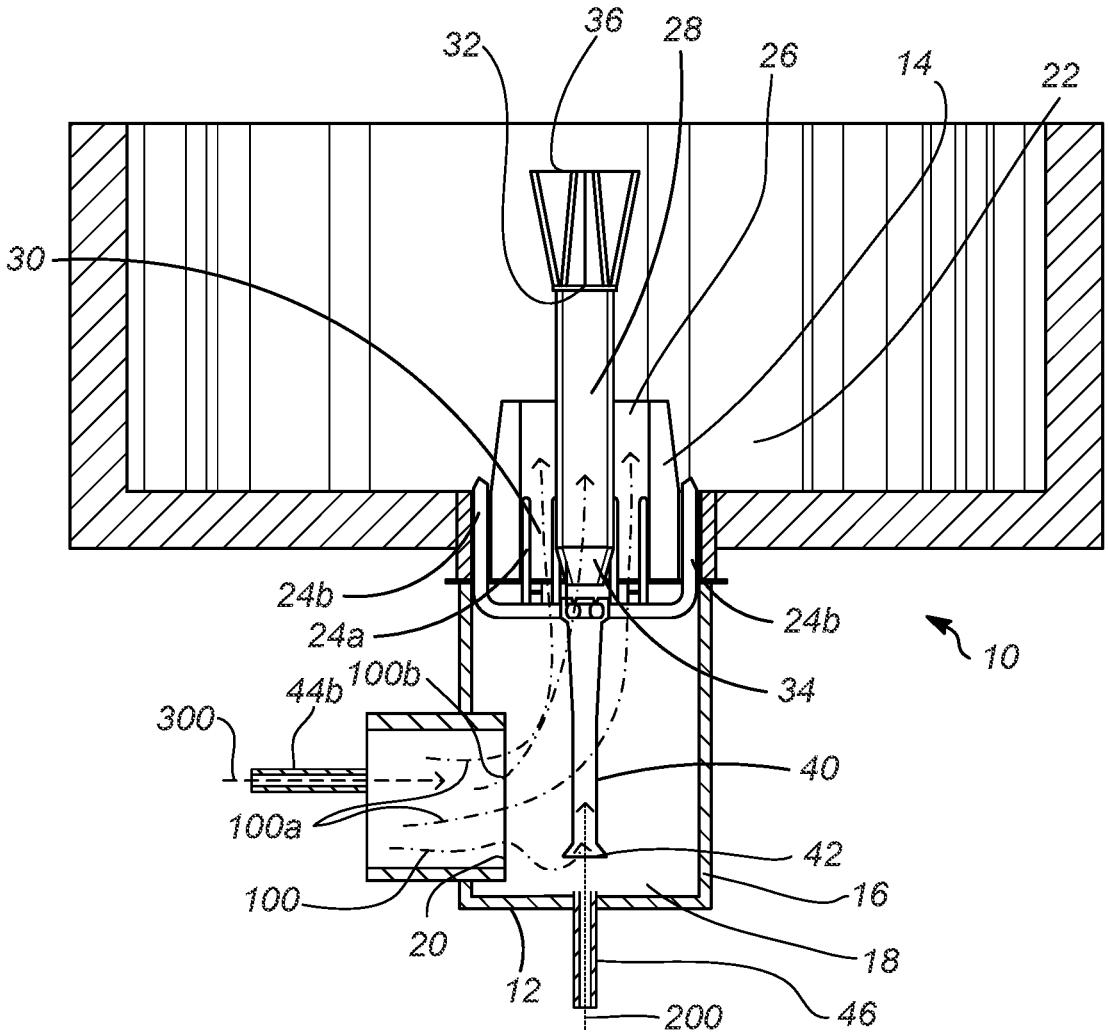
FIG. 5 is a side, cutaway view of a burner according to the present invention.

Accordingly, as shown in FIGS. 1B, 1C, and 2B, for example, in some configurations the bypass conduits 28, and thus their respective inlets 34, may have a generally constant measurement such as a diameter or length or width along a longitudinal axis (running the inlet 34 to the outlet 32) of the bypass conduits 28. Alternatively, in some configurations, as shown in FIG. 4, the inlet 34 may have an increasing measurement (again such as a diameter or length or width) compared with the rest of the bypass conduit 28 so as to provide the inlet with a flared end or with a bell shape. Similarly, in some configurations, as shown in FIG. 5, the inlet 34 may have a decreasing measurement (again such as a diameter or length or width) compared with the rest of the bypass conduit 28 so as to provide the inlet 34 with an inverted cone or pyramid shape. Finally, in general, the inlet 34 can also have a fixed or adjustable opening. In particular, it is contemplated that a louver, register, or damper (not shown) is provided to facilitate variable control of the inlet 34. The inlet 34 may also be ducted from an outside fluid source to facilitate various fluid or air sources.

In addition, the outlets 32 of the bypass conduits 28 may also be configured or designed to achieve specific fluid flow properties. For example, in FIGS. 3 to 5, a mixing device 36 is disposed at the outlet 32 the bypass conduit 28. The mixing device 36 facilitates the low-pressure loss, rapid mixing of the portion of the combustion air flowing though the bypass conduit 28 and the surrounding partially combusted products in the primary combustion zone. Various mixing devices 36 such as static mixers, perforated bluff bodies, spin diffusors and nozzles can be applied at or near (upstream or downstream) of the outlet 32 of the bypass conduits 28 and the depicted mixing device 36 is not intended to be limiting.

By utilizing flow control devices/configurations at the inlet 34 and the outlet 32 of the bypass conduits 28, the partial pressure of oxygen, the available oxygen for combustion, the amount of oxygen and other transported gases, and the rate of mixing of oxygen and other gases may be modulated and optimized either in fixed static designs or as part of actively managed, continuously optimized systems.

In order to further reduce the temperature of the flame in the primary combustion zone, as can be seen in FIGS. 1A and 1B, fins 38 may be provided on an inner surface of the bypass conduit 28. The fins 38 are for heat transfer so that heat that may be radiated or conducted from the burner flame to the bypass conduit 28. The relatively cool combustion air or other media passing through the bypass conduit 28 will conduct heat from the fins 38 thereby cooling the bypass conduit 28 and mitigating any high temperature affects or degradation of the bypass conduit 28 and mitigate NOx formation in the burner flame by cooling the flame.

As noted above, in some configurations of the burner 10 shown in FIGS. 3 to 7, all the fuel gas 200 may be pre-mixed with some portion of the combustion gas 100 prior to injection into the combustion zone 22. Accordingly, with reference to FIG. 5, the burner 10 may include a pre-mixer 40 that has an inlet 42 configured to receive the fuel gas 200 as well as a portion of the combustion air 100 from the plenum 12. This pre-mixed combination will pass through the pre-mixer 40 and then to the fuel lines 24*a* for the primary combustion zone, as well as to the fuel lines 24*b* for the secondary combustion zone. Any combustion air 100 that is pre-mixed with the fuel gas 200 via the pre-mixer 40 is not considered the first and second portions 100*a*, 100*b* of the combustion air 100 discussed above.

In summary, the present burner 10 is believed to produce a flame with a lower NOx production by separating the combustion air into to portions and then staging mixing with fuel gas, downstream of the burner tile 14, in the primary combustion zone.

As noted above, it has been discovered that further control of the NOx production may be achieved by providing an NOx reducing medium 300. These NOx reducing media may include, but are not limited to, fluids such as flue gas from the combustion zone 22, flue gas from the exhaust of the heater, boiler of furnace, steam (water vapor), nitrogen, carbon dioxide or even fuel gas such as methane. It is known that inert gases such as water vapor, nitrogen and carbon dioxide injected in the fuel gas or air stream of a burner can help reduce NOx emissions by reducing the partial pressure of reactants, both fuel and air, cooling and by transferring heat out of the combustion section of the combustion zones. Further, water vapor and flue gas containing water vapor facilitate the WGSR mechanisms of catalyzing and solvating the combustion reactions. Accordingly, in some of the various configurations of the present invention, a portion or all the NOx reducing medium 300 is passed into the bypass conduit(s) 28 to facilitate selective and designed proportioning of the NOx reducing medium in the optimal location(s) in the flame zone(s).

As shown in FIGS. 1C, 2A, 2B, 3, 4, 5, 6, and 7, the NOx reducing medium 300 is injected, via one or more conduits 44*a*, 44*b*, 44*c*, 44*d*, at any one or combinations of locations into the burner 10. For example, in FIGS. 1C, 2A, 2B, 6, and 7, conduits 44*a* inject the NOx reducing medium 300 into the passage 30 of the tile 14 to mix with the first portion 100*a* of combustion air.

Additionally, as shown in FIGS. 3, 4, 5, and 6, conduits 44*b* inject the NOx reducing medium 300 into the plenum 12. Within the plenum 12, the NOx reducing medium 300 will mix with the combustion air 100. The mixture of combustion air 100 and the NOx reducing medium 300 will be passed to the primary combustion zone via both the bypass conduit 28 and the passage 30 of the tile 14 as described above regarding the first and second portions 100*a*, 100*b* of the combustion air.

Further, as shown in FIGS. 3, 4, 6, and 7, conduits 44*c* inject the NOx reducing medium 300 into a conduit 46 that supplies the fuel gas 200 to the burner 10. The mixture of fuel gas and the NOx reducing medium is injected into the pre-mixer 40, drawing some combustion air 100 into the pre-mixer 40 as well.

Figure 6:
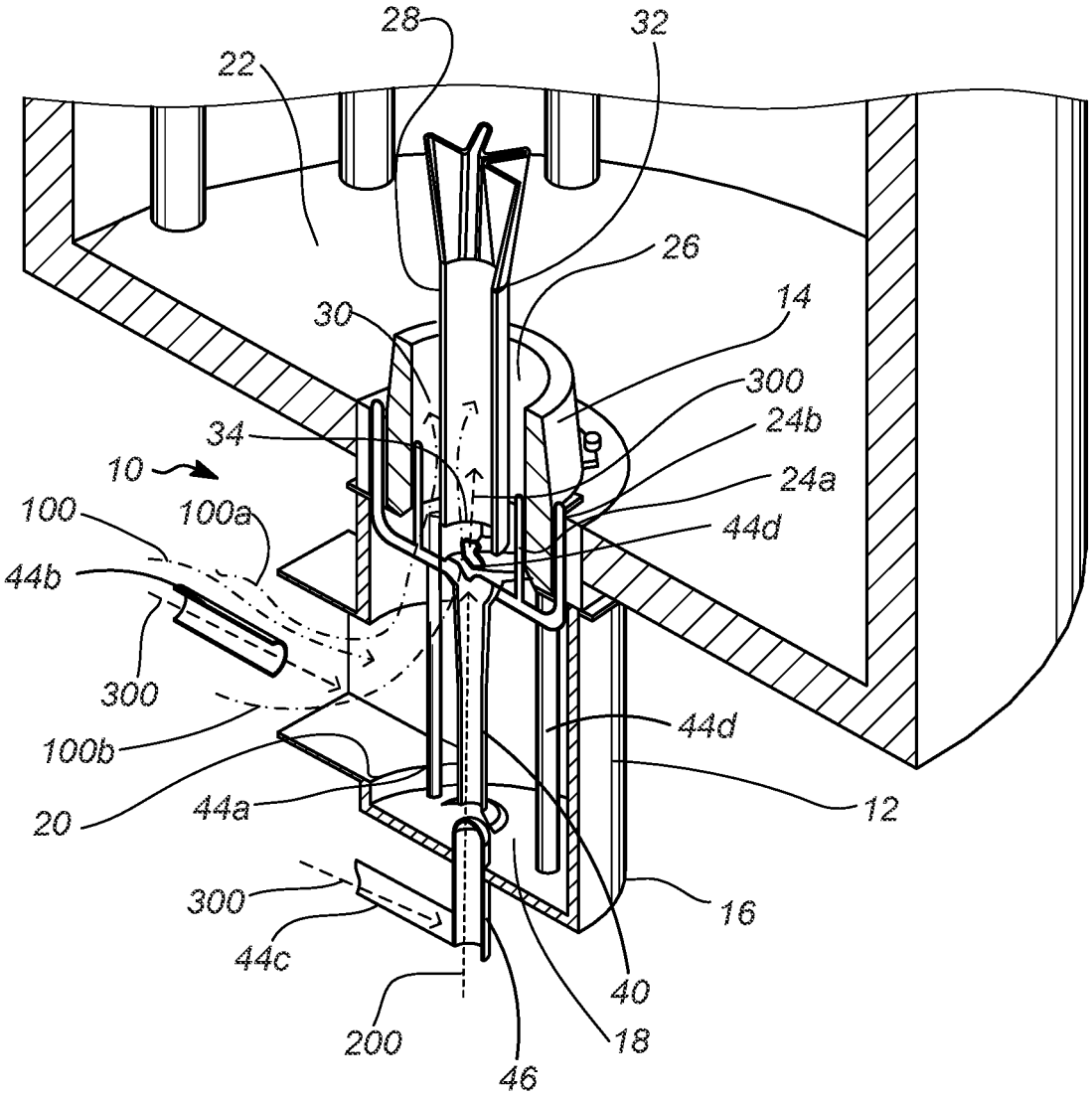
FIG. 6 is a perspective, cutaway view of a burner according to the present invention; and, FIG. 7 is a perspective, cutaway view of a burner according to the present invention.
Figure 7:
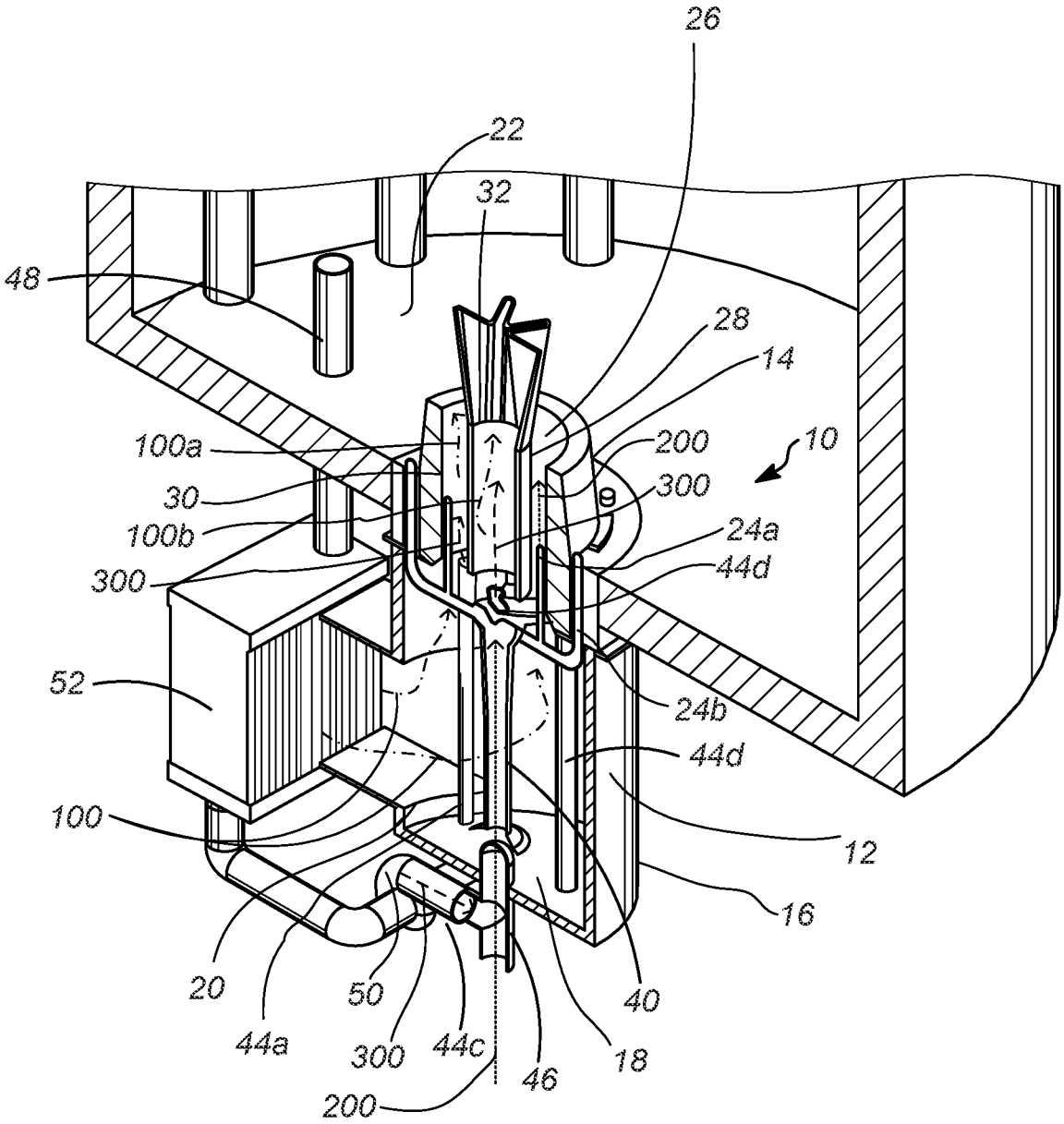

Moreover, it is further contemplated, as shown in FIGS. 6 and 7, that conduits 44*d* inject the NOx reducing medium 300 (mostly) directly into the bypass conduit 28. Additional conduits for the NOx reducing medium 300 could be utilized at a variety of additional places within the burner 10, and a burner 10 may receive different NOx reducing media (i.e., streams with different compositions or different sources).

While there may be many and various sources for the NOx reducing medium, one preferred source is the flue gas from the combustion zone 22 itself. External flue gas recirculation of flue gas is well known and practiced in the industry and involves the movement of flue gas from the exhaust chimney or stack to the inlet of the burner, usually by a powered fan. External flue gas recirculation is costly from both capital and operating cost perspectives. The convection sections of the heater, boiler, or furnace must be made larger to accommodate the addition of the recycled flue gas in the system; the ducting and fan must be purchased and installed; and the fan must be powered and operated. Further, relatively large quantities of external flue gas, around 30% of the flue gas volume, must be recycled to achieve significant NOx reduction when the flue gas is mixed with the combustion air.

In contrast to current designs, in all or some of the configurations of the present invention, as shown in FIG. 7, flue gas may be drawn down directly from combustion zone 22 via a conduit 48 by, for example, a powered fan 50. If necessary, to manage the temperature of the flue gas, a heat exchanger 52 may be provided. Thus, flue gas from the combustion zone 22 may flow on one side of the heat exchanger 52 and combustion air may pass through the other side of the heat exchanger 52 (and be passed to the plenum 12). This heat exchanger 52 not only reduces the temperature of the flue gas to allow easier compression and injection, but it also conserves the heat from the flue gas and reintroduces it to the burner 10 via the combustion air.

The rate of injection of NOx reducing medium may be independent of the fuel gas pressure, flow rate, and composition. In general, the flue gas drawn down from the combustion zone 22 may be injected into any one or any combination of injection points discussed above. For example, the flue gas may be injected, via the conduit 44*c*, into the pre-mixer 40 by being mixed with the fuel gas from the conduit 46, it, although not depicted as such, it could be directly injected into the pre-mixer 40.

In general, greater recirculation and injection of flue gas into the burner 10 will result in lower NOx formation, formed both by Thermal NOx and Prompt NOx mechanisms. Further, these high levels of flue gas recirculation can reduce, or reform, freed nitrogen radicals created from the oxidation or combustion of fuel bound NOx to molecular nitrogen, $N_2$. Therefore, the present burner also reduces NOx formed via the Fuel NOx mechanism.

It has also been discovered that flue gas from a fluidized catalytic cracking (FCC) unit is another source of NOx reducing medium that may be used to reduce NOx production from a burner flame. An exemplary FCC unit is described in U.S. Pat. Pub. Nos. 2021/0009904 and 2020/0325087, both incorporated herein by reference. While the use of the FCC flue gas, alone, is believed to reduce the NOx production, if used in a burner having a bypass conduit 28, the production of NOx gases will be further reduced. However, it is believed that the FCC flue gas could be used with any burner.

The FCC flue gas varies somewhat in composition to heater flue gas often contains some carbon monoxide and other unburned or incompletely burned hydrocarbons or other combustible gases. Thus, the FCC flue gas can also act as some of the fuel gas providing hydrocarbons for combustion. Moreover, the FCC flue gas has a relatively high pressure (0.5 to 4.0 Barg (7.25 to 58 psig) at the burner). This higher-pressure flue gas allows distribution across the refinery/petrochemical complex to multiple and various heaters, boilers and furnaces and their burners. At pressure, this FCC flue gas may not require the heat exchanger 52 and fan 50 as depicted in FIG. 7.

It is believed to be particularly advantageous if the FCC flue gas is used within the FCC unit. Specifically, the FCC unit utilizes steam for various aspects, including as an NOx reducing medium in burners within the FCC unit. The FCC flue gas may replace some or all the steam typically used in FCC units, thereby lowering the operating costs while producing a stable flame with low NOx production. Again, while not required, the burner in the FCC unit may include the bypass conduit 28 described above.

By designing for and actively controlling the injection rates, locations, localized stoichiometry and NOx reducing medium introduced to the combustion process, the flame, the NOx production can be mitigated to extremely low values, less than 10 ppmvd with relatively modest amounts of NOx reducing media such as flue gas. Increasing rates of flue gas recirculation, while further reducing NOx, can lead to burner instability and/or loss of flame. By designing for and actively controlling the injection rates, locations, localized stoichiometry and NOx reducing medium introduced to the combustion process, the flame and the NOx formation can be mitigated while maintaining good burner and flame stability and continuous operation.

While the lowest NOx emissions may be produced when the burner 10 is receiving highest rates of NOx reducing medium, this may also be the incipient point of burner instability. This incipient instability can be detected by a high-speed pressure transmitter and associated instability detection software similar to that described in U.S. Pat. No. 7,950,919. However, unlike U.S. Pat. No. 7,950,919 where principally combustion chamber oxygen is controlled and adjusted to react to instability, in this invention, the rate and location of NOx reducing medium can be controlled.

Generally, the NOx emissions from the heater may be monitored along with the stack oxygen and the combustion chamber pressure or draft. The rate, the amount of NOx reducing medium delivered, or both may be increased at the desired locations in the flame zone until the required NOx reduction is achieved. Once the desired NOx level is achieved no additional NOx reducing medium may be introduced. If the burner becomes unstable, the rate and/or location of the NOx reducing medium can be controlled or the excess air, oxygen levels adjusted as suggested in U.S. Pat. No. 7,950,919 until burner stability is achieved.

It is further contemplated that visual field or infrared cameras may be used to monitor flame stability and quality aspects using artificial intelligence, AI, such as described in U.S. Patent Publ. No. 2020/0386404 (incorporated herein by reference). When instabilities or other anomalies in the flame image are detected with the AI, the amount and location of the NOx reducing medium and/or other control aspects of the heater controls system, such as excess oxygen, can be adjusted and controlled to simultaneously deliver the lowest level of NOx (or at least the required level) with good burner flame stability.

If there is a loss of NOx reducing medium at any time or at any moment, the present burner 10 will still work safely as a conventional low NOx burner. The NOx emissions may increase, but the burner 10 will otherwise remain stable and continue to deliver heat reliably to the process in the heater, boiler or furnace. Further, the burner 10 will operate, in the view of the burner operator, just as conventional burners operate with no special operational issues.

The introduction of NOx reducing medium may be by fix, static control devices or by automated computer control. Therefore, the burner operates, to the point of view of the operator, conventionally with draft and oxygen control as prescribed in API Recommended Practice 535, Third Edition, May 2014, Burners for Fired Heaters in General Refinery Service. Namely draft and oxygen are controlled with the stack damper and burner air inlet register and/or the induced draft fan and forced draft fan control settings.

It should be appreciated and understood by those of ordinary skill in the art that various other components such as valves, pumps, fans, filters, coolers, etc. were not shown in the drawings as it is believed that the specifics of same are well within the knowledge of those of ordinary skill in the art and a description of same is not necessary for practicing or understanding the embodiments of the present invention.

Any of the above lines, conduits, units, devices, vessels, surrounding environments, zones or similar may be equipped with one or more monitoring components including sensors, measurement devices, data capture devices or data transmission devices. Signals, process or status measurements, and data from monitoring components may be used to monitor conditions in, around, and on process equipment. Signals, measurements, and/or data generated or recorded by monitoring components may be collected, processed, and/or transmitted through one or more networks or connections that may be private or public, general or specific, direct or indirect, wired or wireless, encrypted or not encrypted, and/or combination(s) thereof; the specification is not intended to be limiting in this respect.

Signals, measurements, and/or data generated or recorded by monitoring components may be transmitted to one or more computing devices or systems. Computing devices or systems may include at least one processor and memory storing computer-readable instructions that, when executed by the at least one processor, cause the one or more computing devices to perform a process that may include one or more steps. For example, the one or more computing devices may be configured to receive, from one or more monitoring component, data related to at least one piece of equipment associated with the process. The one or more computing devices or systems may be configured to analyze the data. Based on analyzing the data, the one or more computing devices or systems may be configured to determine one or more recommended adjustments to one or more parameters of one or more processes described herein. The one or more computing devices or systems may be configured to transmit encrypted or unencrypted data that includes the one or more recommended adjustments to the one or more parameters of the one or more processes described herein.

The computing device of system unit may comprise, for example, any type of general-purpose microprocessor or microcontroller, a digital signal processing (DSP) processor, a central processing unit (CPU), an integrated circuit, a field programmable gate array (FPGA), a reconfigurable processor, other suitably programmed or programmable logic circuits, or any combination thereof.

The memory may be any suitable known or other machine-readable storage medium. The memory may comprise non-transitory computer readable storage medium such as, for example, but not limited to, an electronic, magnetic, optical, electromagnetic, infrared, or semiconductor system, apparatus, or device, or any suitable combination of the foregoing. The memory may include a suitable combination of any type of computer memory that is located either internally or externally to the device such as, for example, random-access memory (RANI), read-only memory (ROM), compact disc read-only memory (CDROM), electro-optical memory, magneto-optical memory, erasable programmable read-only memory (EPROM), and electrically-erasable programmable read-only memory (EEPROM), Ferroelectric RAM (FRAM) or the like. The memory may comprise any storage means (e.g., devices) suitable for retrievably storing the computer-executable instructions executable by the controller or a computing device.

The methods and steps described herein may be implemented in a high-level procedural or object-oriented programming or scripting language, or a combination thereof, to communicate with or assist in the operation of the controller or computing device. Alternatively, the methods and systems described herein may be implemented in assembly or machine language. The language may be a compiled or interpreted language. Program code for implementing the methods and systems for control gas flow to a burner described herein may be stored on the storage media or the device, for example a ROM, a magnetic disk, an optical disc, a flash drive, or any other suitable storage media or device. The program code may be readable by a general or special-purpose programmable computer for configuring and operating the computer when the storage media or device is read by the computer to perform the procedures described herein.

Computer-executable instructions may be in many forms, including program modules, executed by one or more computers or other devices. Generally, program modules include routines, programs, objects, components, data structures, etc., that perform particular tasks or implement particular abstract data types. Typically, the functionality of the program modules may be combined or distributed as desired in various embodiments.

SPECIFIC EMBODIMENTS

While the following is described in conjunction with specific embodiments, it will be understood that this description is intended to illustrate and not limit the scope of the preceding description and the appended claims.

A first embodiment of the invention is a burner comprising a plenum; a burner tile arranged such that a first portion of a combustion air from the plenum flows from the plenum through the burner tile to a primary combustion zone; at least one conduit having an outlet configured to inject a fuel stream comprising a fuel gas into the primary combustion zone; and, a bypass conduit having an outlet configured to inject a second portion of the combustion air from the plenum into the primary combustion zone, wherein the second portion of the combustion air is injected downstream relative to the first portion of the combustion air. An embodiment of the invention is one, any or all of prior embodiments in this paragraph up through the first embodiment in this paragraph, further comprising a plurality of bypass conduits each having an outlet configured to inject some of the second portion of the combustion air from the plenum into the primary combustion zone. An embodiment of the invention is one, any or all of prior embodiments in this paragraph up through the first embodiment in this paragraph, wherein the bypass conduits from the plurality of bypass conduits are concentric. An embodiment of the invention is one, any or all of prior embodiments in this paragraph up through the first embodiment in this paragraph, wherein the bypass conduits from the plurality of bypass conduits each have a different length relative to a distance from the burner tile to the outlets of each of the bypass conduits. An embodiment of the invention is one, any or all of prior embodiments in this paragraph up through the first embodiment in this paragraph, wherein the bypass conduits from the plurality of bypass conduits are arranged in a parallel arrangement. An embodiment of the invention is one, any or all of prior embodiments in this paragraph up through the first embodiment in this paragraph, further comprising a pre-mixer configured to mix the fuel gas and some of the combustion air upstream of the combustion zone such that the fuel stream further comprises the combustion air. An embodiment of the invention is one, any or all of prior embodiments in this paragraph up through the first embodiment in this paragraph, wherein the bypass conduit has an inlet, and wherein the inlet has either an increasing inner measurement to increase a proportion of the combustion air entering the bypass conduit from the plenum or a decreasing inner measurement to decrease a proportion of the combustion air entering the bypass conduit from the plenum. An embodiment of the invention is one, any or all of prior embodiments in this paragraph up through the first embodiment in this paragraph, further comprising at least one conduit configured to pass an NOx reducing medium to the combustion zone.

A second embodiment of the invention is a burner comprising a plenum; a burner tile arranged such that a first portion of a combustion air from the plenum flows from the plenum through a passage in the burner tile to a primary combustion zone; at least one conduit having an outlet configured to inject a fuel stream comprising a fuel gas into the primary combustion zone; a bypass conduit having an outlet configured to inject a second portion of the combustion air from the plenum into the primary combustion zone, wherein the second portion of the combustion air is injected downstream relative to the first portion of the combustion air; and, at least one conduit configured to pass an NOx reducing medium into the bypass conduit, the passage in the burner tile, or both. An embodiment of the invention is one, any or all of prior embodiments in this paragraph up through the second embodiment in this paragraph, wherein the NOx reducing medium comprises recycled flue gas produced in the primary combustion zone. An embodiment of the invention is one, any or all of prior embodiments in this paragraph up through the second embodiment in this paragraph, further comprising a fan configured to draw flue gas from the primary combustion zone to a recycle conduit. An embodiment of the invention is one, any or all of prior embodiments in this paragraph up through the second embodiment in this paragraph, further comprising a heat exchanger configured to recover heat from and cool the recycled flue gas before the recycled flue gas is passed back to the primary combustion zone. An embodiment of the invention is one, any or all of prior embodiments in this paragraph up through the second embodiment in this paragraph, further comprising a pre-mixer configured to mix the fuel gas and some of the combustion air upstream of the combustion zone such that the fuel stream further comprises the combustion air, and wherein the NOx reducing medium is injected into the pre-mixer. An embodiment of the invention is one, any or all of prior embodiments in this paragraph up through the second embodiment in this paragraph, wherein the NOx reducing medium is mixed with the fuel gas prior to the fuel gas being injected into the pre-mixer. An embodiment of the invention is one, any or all of prior embodiments in this paragraph up through the second embodiment in this paragraph, wherein the NOx reducing medium is mixed with the combustion air in the plenum.

A third embodiment of the invention is a process for reducing production of NOx gases at a burner, the process comprising injecting a fuel gas into a primary combustion zone associated with a burner tile; injecting a first portion of a combustion air into the primary combustion zone, wherein the first portion of the combustion air and the fuel gas react and produce a flame in the primary combustion zone; and, injecting a second portion of the combustion air into the primary combustion zone, wherein the second portion of the combustion air is injected into the primary combustion zone downstream relative to the first portion of the combustion air. An embodiment of the invention is one, any or all of prior embodiments in this paragraph up through the third embodiment in this paragraph, wherein the second portion of the combustion air is injected via a bypass conduit. An embodiment of the invention is one, any or all of prior embodiments in this paragraph up through the third embodiment in this paragraph, wherein the second portion of the combustion air is injected via a plurality of bypass conduits each having an outlet configured to inject the second portion of the combustion air into the primary combustion zone. An embodiment of the invention is one, any or all of prior embodiments in this paragraph up through the third embodiment in this paragraph, wherein the bypass conduits from the plurality of bypass conduits are concentric. An embodiment of the invention is one, any or all of prior embodiments in this paragraph up through the third embodiment in this paragraph, wherein the bypass conduits from the plurality of bypass conduits each have a different length relative to a distance to from the burner tile to the outlets of each of the bypass conduits. An embodiment of the invention is one, any or all of prior embodiments in this paragraph up through the third embodiment in this paragraph, further comprising passing an NOx reducing medium to the primary combustion zone. An embodiment of the invention is one, any or all of prior embodiments in this paragraph up through the third embodiment in this paragraph, wherein the NOx reducing medium comprises a recycled flue gas from the primary combustion zone. An embodiment of the invention is one, any or all of prior embodiments in this paragraph up through the third embodiment in this paragraph, wherein the NOx reducing medium comprises a flue gas from an FCC unit.

A fourth embodiment of the invention is a process for reducing production of NOx gases at a burner, the process comprising injecting a fuel gas into a primary combustion zone associated with a burner tile; injecting a first portion of a combustion air into the primary combustion zone, wherein the first portion of the combustion air and the fuel gas react and produce a flame in the primary combustion zone; injecting, via a bypass conduit, a second portion of the combustion air into the primary combustion zone, wherein the second portion of the combustion air is injected into the primary combustion zone downstream relative to the first portion of the combustion air; and, injecting an NOx reducing medium into the bypass conduit. An embodiment of the invention is one, any or all of prior embodiments in this paragraph up through the fourth embodiment in this paragraph, further comprising monitoring at least one NOx value for the flame; and, adjusting a flowrate of the NOx reducing medium based on the at least one NOx value. An embodiment of the invention is one, any or all of prior embodiments in this paragraph up through the fourth embodiment in this paragraph, wherein the NOx reducing medium comprises a recycled flue gas from the primary combustion zone. An embodiment of the invention is one, any or all of prior embodiments in this paragraph up through the fourth embodiment in this paragraph, wherein the NOx reducing medium comprises a flue gas from an FCC unit.

A fifth embodiment of the invention is a process for reducing production of NOx gases at a burner, the process comprising injecting a fuel gas into a primary combustion zone associated with a burner tile; injecting a first portion of a combustion air into the primary combustion zone, wherein the first portion of the combustion air and the fuel gas react and produce a flame and a flue gas in the primary combustion zone; injecting a second portion of the combustion air into the primary combustion zone, wherein the second portion of the combustion air is injected into the primary combustion zone downstream relative to the first portion of the combustion air; and, recovering a portion of the flue gas produced in the primary combustion zone and recycling the portion of the flue gas back to the primary combustion zone. An embodiment of the invention is one, any or all of prior embodiments in this paragraph up through the fifth embodiment in this paragraph, further comprising recovering heat from and cooling the portion of the flue gas recovered before the flue gas is recycled back to the primary combustion zone. An embodiment of the invention is one, any or all of prior embodiments in this paragraph up through the fifth embodiment in this paragraph, further comprising mixing the portion of the flue gas recovered with the combustion air. An embodiment of the invention is one, any or all of prior embodiments in this paragraph up through the fifth embodiment in this paragraph, further comprising mixing the portion of the flue gas recovered with the first portion of the combustion air. An embodiment of the invention is one, any or all of prior embodiments in this paragraph up through the fifth embodiment in this paragraph, further comprising mixing the portion of the flue gas recovered with the second portion of the combustion air. An embodiment of the invention is one, any or all of prior embodiments in this paragraph up through the fifth embodiment in this paragraph, further comprising mixing the portion of the flue gas recovered with the fuel gas. An embodiment of the invention is one, any or all of prior embodiments in this paragraph up through the fifth embodiment in this paragraph, further comprising injecting the portion of the flue gas recovered and the fuel gas into a pre-mixer.

A sixth embodiment of the invention is a process for reducing production of NOx gases at a burner, the process comprising injecting a fuel gas into a primary combustion zone associated with a burner tile; injecting a combustion air into the primary combustion zone, wherein the combustion air and the fuel gas react and produce a flame and a flue gas in the combustion zone; and, injecting an NOx reducing medium into the primary combustion zone to reduce an NOx production at the flame, wherein the NOx reducing medium comprises a flue gas from an FCC unit. An embodiment of the invention is one, any or all of prior embodiments in this paragraph up through the sixth embodiment in this paragraph, wherein the burner tile is associated with a burner in the FCC unit. An embodiment of the invention is one, any or all of prior embodiments in this paragraph up through the sixth embodiment in this paragraph, further comprising mixing the NOx reducing medium with the combustion air prior to the combustion air being injected into the primary combustion zone. An embodiment of the invention is one, any or all of prior embodiments in this paragraph up through the sixth embodiment in this paragraph, further comprising mixing the NOx reducing medium with the fuel gas prior to the fuel gas being injected into the primary combustion zone. An embodiment of the invention is one, any or all of prior embodiments in this paragraph up through the sixth embodiment in this paragraph, further comprising mixing the NOx reducing medium with the fuel gas prior to the fuel gas being injected into the primary combustion zone.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A burner comprising:

a plenum;

a burner tile arranged such that a first portion of a combustion air from the plenum flows from the plenum through a passage in the burner tile to a primary combustion zone;

at least one conduit having an outlet configured to inject a fuel stream comprising a fuel gas into the primary combustion zone;

a bypass conduit having an outlet configured to inject a second portion of the combustion air from the plenum into the primary combustion zone, wherein the second portion of the combustion air is injected downstream relative to the first portion of the combustion air;

at least one conduit configured to pass an NOx reducing medium into the bypass conduit, the passage in the burner tile, or both; and a pre-mixer configured to mix the fuel gas and a portion of the combustion air upstream of the combustion zone such that the fuel stream further comprises the combustion air, wherein the NOx reducing medium is injected into the pre-mixer, and wherein the NOx reducing medium is mixed with the fuel gas prior to the fuel gas being injected into the pre-mixer.

2. The burner of claim 1, wherein the NOx reducing medium comprises recycled flue gas produced in the primary combustion zone.

3. The burner of claim 2, further comprising:

a fan configured to a draw flue gas from the primary combustion zone to a recycle conduit.

4. The burner of claim 2, further comprising:

a heat exchanger configured to recover heat from and cool the recycled flue gas before the recycled flue gas is passed back to the primary combustion zone.

5. The burner of claim 1, wherein the NOx reducing medium is mixed with the combustion air in the plenum.

6. A process for reducing production of NOx gases at a burner, the process comprising:

injecting a fuel gas into a primary combustion zone associated with a burner tile;

injecting a first portion of a combustion air into the primary combustion zone through a passing the burner tile, wherein the first portion of the combustion air and the fuel gas react and produce a flame in the primary combustion zone;

injecting, via a bypass conduit, a second portion of the combustion air into the primary combustion zone, wherein the second portion of the combustion air is injected into the primary combustion zone downstream relative to the first portion of the combustion air;

passing an NOx reducing medium into the bypass conduit, the passage in the burner tile, or both;

monitoring at least one NOx value for the flame; and, adjusting a flowrate of the NOx reducing medium based on the at least one NOx value.

7. The process of claim 6, wherein the NOx reducing medium comprises a recycled flue gas from the primary combustion zone.

8. The process of claim 6, wherein the NOx reducing medium comprises a flue gas from an FCC unit.

9. The process of claim 6, further comprising:

drawing, with a fan, a portion of a flue gas from the primary combustion zone to a recycle conduit.

10. The process of claim 6, further comprising:

recovering heat, via a heat exchanger, from the flue gas;

passing the flue gas back to the primary combustion zone as the NOx reducing medium.

11. A process for reducing production of NOx gases at a burner, the process comprising:

injecting a fuel gas into a primary combustion zone associated with a burner tile;

injecting a first portion of a combustion air into the primary combustion zone, wherein the first portion of the combustion air and the fuel gas react and produce a flame and a flue gas in the primary combustion zone;

injecting a second portion of the combustion air into the primary combustion zone, wherein the second portion of the combustion air is injected into the primary combustion zone downstream relative to the first portion of the combustion air;

recovering a portion of the flue gas produced in the primary combustion zone and recycling the portion of the flue gas back to the primary combustion zone;

monitoring at least one NOx value for the flame; and, adjusting a flowrate of the NOx reducing medium through a bypass conduit, a passage in the burner tile, or both based on the at least one NOx value.

12. The process of claim 11, further comprising:

recovering heat from and cooling the portion of the flue gas recovered before the flue gas is recycled back to the primary combustion zone.

13. The process of claim 12, further comprising:

mixing the portion of the flue gas recovered with the combustion air.

14. The process of claim 13, further comprising:

mixing the portion of the flue gas recovered with the first portion of the combustion air.

15. The process of claim 13, further comprising:

mixing the portion of the flue gas recovered with the second portion of the combustion air.

16. The process of claim 15, further comprising:

mixing the portion of the flue gas recovered with the fuel gas.

17. The process of claim 12, further comprising:

injecting the portion of the flue gas recovered and the fuel gas into a pre-mixer.

* * * * *